US007499255B2

(12) United States Patent
Domo et al.

(10) Patent No.: US 7,499,255 B2
(45) Date of Patent: Mar. 3, 2009

(54) VACUUM-TYPE ELECTRICAL SWITCHING APPARATUS

(75) Inventors: James Francis Domo, Chagrin Falls, OH (US); Lance Patrick Sabados, Olmstead Township, OH (US); Steven Jay Randazzo, San Jose, CA (US); Roderick C. Mosely, Pleasanton, CA (US); Joseph Emil Oeschger, Palo Alto, CA (US); Mary Grace Bello Montesclaros, San Jose, CA (US)

(73) Assignee: Thomas & Betts International, Inc., Wilmington, DE (US)

( * ) Notice: Subject to any disclaimer, the term of this patent is extended or adjusted under 35 U.S.C. 154(b) by 447 days.

(21) Appl. No.: 11/344,284

(22) Filed: Jan. 31, 2006

(65) Prior Publication Data

US 2006/0126257 A1 Jun. 15, 2006

(51) Int. Cl.
*H01H 47/24* (2006.01)
*G08B 21/00* (2006.01)

(52) U.S. Cl. ..... 361/174; 340/626; 340/644

(58) Field of Classification Search ..... 361/174
See application file for complete search history.

(56) References Cited

U.S. PATENT DOCUMENTS 1,731,866 A 10/1929 Rice
4,103,291 A 7/1978 Howe et al.
4,484,818 A 11/1984 Houston
4,553,139 A * 11/1985 Tanigaki et al. ..... 340/626
5,237,482 A 8/1993 Osterhout et al.
5,748,093 A 5/1998 Swanson et al.
6,659,037 B2 12/2003 Hagopian
6,799,154 B1 9/2004 Aragones et al.
6,947,797 B2 9/2005 Dean et al.
2005/0258342 A1 11/2005 Egermeier et al.

* cited by examiner

*Primary Examiner*—Michael J Sherry
*Assistant Examiner*—Dharti H Patel
(74) *Attorney, Agent, or Firm*—David G. Maire; Beusse Wolter Sanks Mora & Maire, PA

(57) ABSTRACT

A vacuum-type electrical switching apparatus (10) for high voltage electrical power. A vacuum pressure condition in a vacuum pressure space (21) surrounding electrical contact points (18) is monitored and movement of the contact points between open and closed positions is automatically prevented when the pressure exceeds a predetermined threshold in order to avoid destructive arcing between the points. A sensor (32) provides a vacuum signal (34) responsive to the vacuum pressure condition. A controller (36) automatically inhibits movements of the contact points when the vacuum signal indicates that the vacuum has degraded. A contactor (38) may be placed in series with power supply (28) and a solenoid (24) used to move the contact points, with the contactor being automatically opened by the controller in response to the degraded vacuum condition. An electromechanical opening inhibitor (74) may be energized by the controller to mechanically prevent the contact points from being moved in response to the degraded vacuum condition.

20 Claims, 3 Drawing Sheets

VACUUM-TYPE ELECTRICAL SWITCHING APPARATUS

FIELD OF THE INVENTION

This invention relates generally to the field of vacuum-type electrical switching devices for high voltage, high power applications.

BACKGROUND OF THE INVENTION

Various devices are used to control the flow of high voltage electrical power (for example greater than 1,000 VAC) in the electric utility and industrial applications. Such devices include circuit breakers, reclosers, capacitor switches, automatic and non-automatic sectionalizers and air-switch attachments, and they are referred to herein with the general terms switch or switching apparatus. While semiconductor switches have been developed, mechanical switches are still preferred for most high voltage applications. Such devices incorporate mating electrical contact points that are separated from each other to block the flow of current and that are joined together to allow current to flow through the switch. In order to interrupt the electrical circuit when opened, the contacts are typically immersed in oil having a high dielectric strength, or they are contained in an insulating gas such as $SF_6$ or in a vacuum pressure space. Loss of vacuum in a vacuum-type device will allow significant arcing to occur when the contacts are opened or will allow over-heating to occur when the contacts are closed, thereby causing damage to the contacts and creating the potential for injury to persons located near the switch.

Devices are known for monitoring the pressure in the vacuum pressure space of vacuum-type switches. United States Patent Application Publication No. US 2005/0258342 A1 and U.S. Pat. Nos. 4,103,291 and 4,484,818, each incorporated by reference herein, describe examples of such devices. These monitoring devices are used to provide an indication of when the vacuum conditions surrounding the contact points have degraded. In spite of the existence of such devices for monitoring of the vacuum conditions, vacuum-type switches are often damaged due to the operation of the switch with a degraded vacuum condition surrounding the electrical contact points. An improved electrical switching apparatus that avoids such damage is needed.

BRIEF DESCRIPTION OF THE DRAWINGS

The invention is explained in following description in view of the drawings that show.

DETAILED DESCRIPTION OF THE INVENTION

Figure 1:
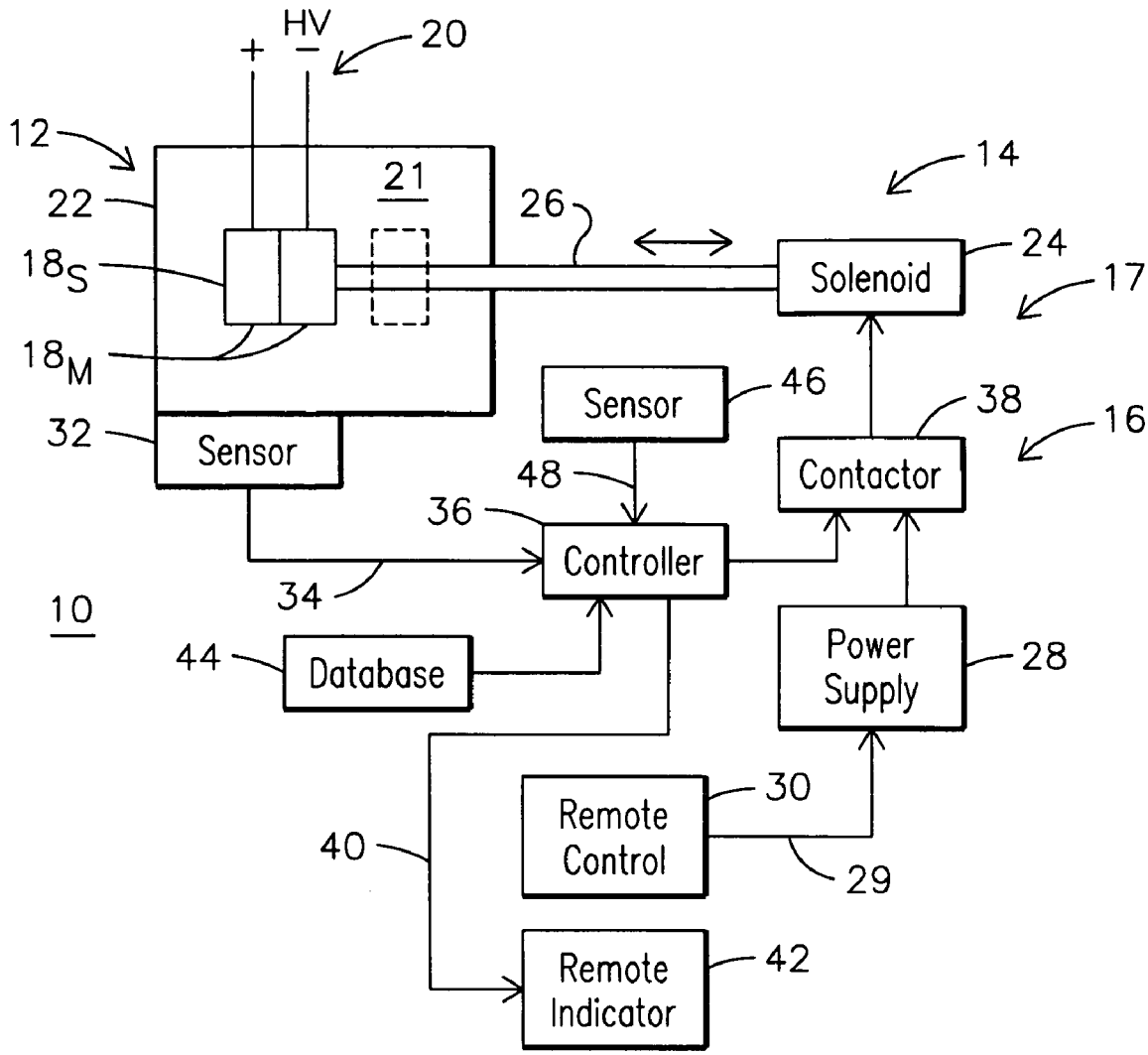
FIG. 1 is a schematic illustration of an improved vacuum-type electrical switching apparatus.

Switching apparatus 10 of FIG. 1 includes a vacuum interrupter 12, a drive mechanism 14 for selectively switching the interrupter 12 between open and closed positions, and a lockout apparatus 16 for preventing the switching of the interrupter 12 under conditions that could cause damage to the equipment or injury to persons. The vacuum interrupter 12 includes mating electrical contact points 18 (illustrated as a stationary contact 18*s* and a moveable contact 18*m*) arranged for relative movement between a closed position, in which the contact points are in engagement for a flow of electrical current through the switching apparatus 10 as part of high voltage circuit 20, and an open position in which the contact points are spaced apart (such as with moveable contact 18*m* displaced as illustrated in phantom) to block the flow of electrical current through the switch 10. The contact points 18 are surrounded by a pressure boundary 22 defining a vacuum pressure space 21 within the pressure boundary 22. The vacuum pressure condition minimizes arcing between the contact points 18 when they are moved between the open and closed positions at high voltage potential.

The drive mechanism 14 may include a solenoid 24 connected to the moveable contact point 18*m* via an electrically insulating rod 26 of a suitable dielectric material such as fiberglass. The solenoid 24 may be selectively energized by a power supply 28, which is responsive to a control signal 29 generated in response to operator input via a remote control 30. The remote control 30 may be located in the general vicinity of the vacuum interrupter 12 or it may be distantly remote. Under normal operating conditions when the vacuum pressure within the pressure boundary 22 is acceptably low, the operator input via the remote control 30 is effective to connect the power supply 28 with the solenoid 24 to selectively move the contact points 18 between the open and closed positions.

The lockout apparatus 16 prevents the relative movement (opening or closing) of the contact points 18 when the pressure within the pressure boundary 22 is above a predetermined threshold value. The threshold value may be selected to avoid damage to equipment and danger to nearby persons due to arcing between the contact points 18, and may be approximately 10-2 torr to 10-4 torr in various embodiments, for example. The lockout apparatus 16 includes a sensor 32 associated with the vacuum interrupter 12 for generating a vacuum signal 34 responsive to the vacuum pressure condition within the pressure boundary 22. Examples of such sensors 32 are described in the aforementioned United States Patent Application Publication No. 2005/0258342 A1. Vacuum signal 34 is used to control the state of a controller 36 and a contactor 38 disposed in series with the solenoid 24 and power supply 28. When sensor 32 detects a degraded (raised) pressure condition within the pressure boundary 22, controller 36 receives the corresponding vacuum signal 34 and, in turn, opens contactor 38 to prevent the energizing of solenoid 24, thereby preventing the movement of contacts 18. Thus the drive mechanism 14 and lockout apparatus 16 function together as a control element 17 responsive to both the control signal 29 and vacuum signal 34 to control the movement of the contact points 18 when the vacuum pressure is acceptable and automatically to prevent the movement of the contact points 18 when the vacuum pressure is degraded. Since nearly all operations of vacuum-type switches are controlled electrically from either a local or remote control, the present invention will be effective in preventing changes of state of such switches when the protective vacuum has degraded. By preventing operations with a loss of vacuum condition, the potential for catastrophic failures and personal injury will be minimized.

Controller 36 may also generate an indication signal 40 for an indicator 42 to signal the degraded/raised pressure condition. The indicator 42 may be a light or other visual or audible device and it may be part of an operator control display. The indicator 42 may be disposed proximate the remote control 30 or at a related site, such as at a centralized maintenance or service center for alerting appropriate maintenance personnel to the need for servicing of the vacuum interrupter 12. Indication signal 40 and/or control signal 29 may be transmitted via a network, such as the Internet or wireless communication network.

Vacuum-type switches may develop small leaks that result in a very slow loss of vacuum conditions, for example over a period of months or even years. A history of the pressure values measured by sensor 32 may be stored in a database 44. The history may be a time history, and/or the data may be recorded historically against another count variable, such as number of cycles of contact point movement. Controller 36 or another processor may be used to access the database 44 to develop trending information from the history of pressure information, thereby providing a predictive capability for use in making maintenance decisions. The trending information may be an extrapolation of sensed pressures to forecast when the pressure is expected to reach a threshold value, with repair/replacement of the vacuum interrupter 12 being scheduled prior to the pressure degrading to the point of causing damage to the equipment when the contacts 18 are moved. The trending information and any forecast data may be displayed remotely via remote indicator 42, such as at a maintenance/repair facility.

FIG. 1 also illustrates a second sensor 46 providing an environment signal 48 responsive to a parameter of the environment of the pressure boundary 22. Such environmental parameters may include temperature, voltage, mechanical shock, lightning detection, breaker position, or other parameter affecting the switching apparatus 10 and specifically the integrity of the pressure boundary 22. The database 44 may be used to correlate the history of the vacuum signal 34 and a corresponding history of the environmental signal 48. Such information may be useful in diagnosing a cause of loss of vacuum within the vacuum pressure space 21. For example, if the pressure begins to increase shortly after a voltage excursion in circuit 20, one may conclude that the voltage excursion caused some mechanical failure of the pressure boundary 22. Such correlations may be useful for determining the root cause of a switching apparatus pressure loss condition, and subsequently in assessing economic responsibility for the repair of the degraded condition.

Figure 2:
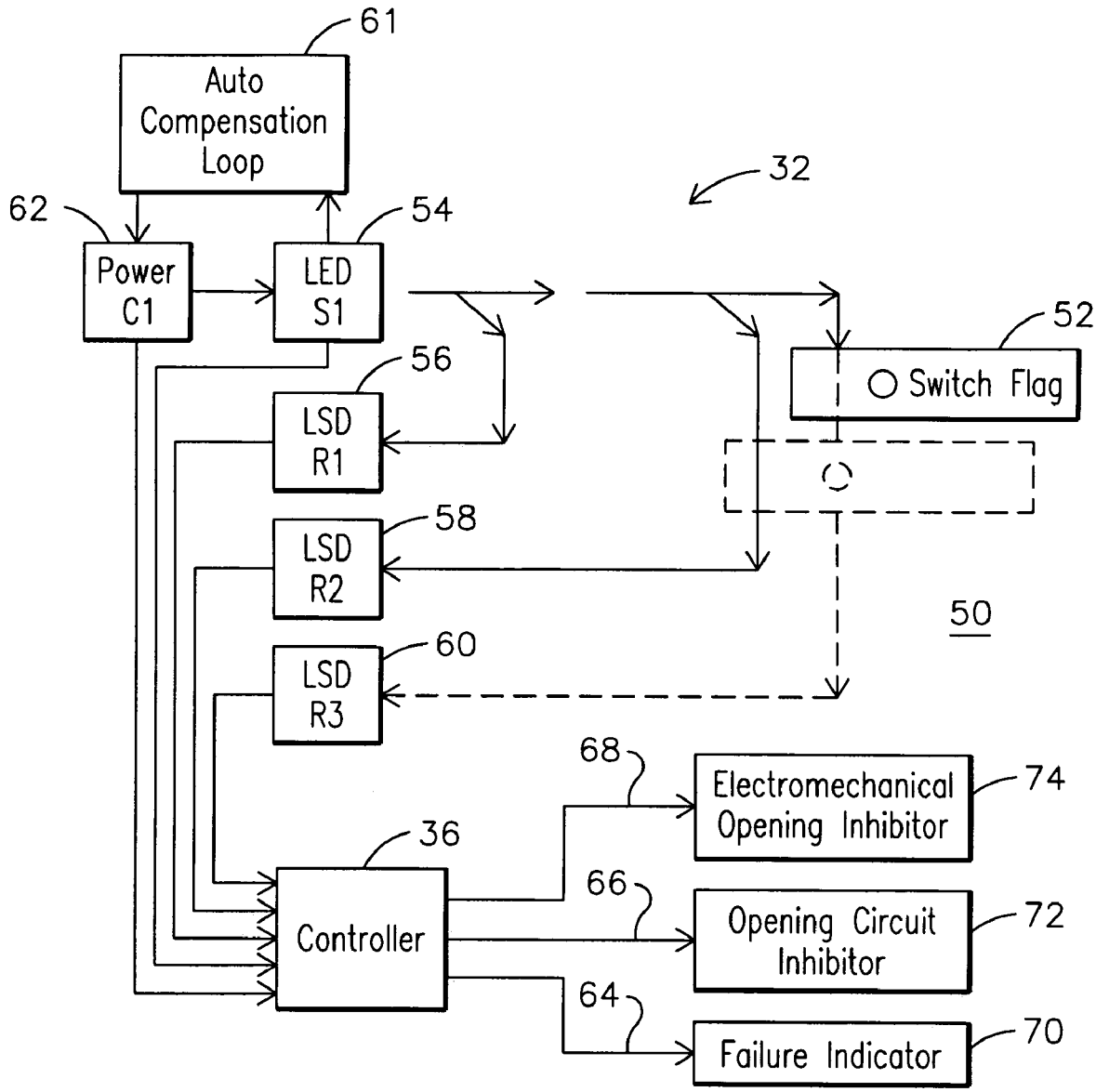
FIG. 2 is a schematic illustration of one embodiment of a lockout apparatus as may be used with the vacuum-type electrical switching apparatus of FIG. 1.

FIG. 2 illustrates one embodiment of a lockout apparatus 50 as may be used with the vacuum-type electrical switching apparatus 10 of FIG. 1. In this embodiment, the vacuum pressure sensor 32 includes a flag 52, which is an element that moves in response to changes in the pressure within the vacuum pressure space 21. FIG. 2 illustrates the flag 52 in solid lines in a normal operation position, and in dashed lines in a switch failure position (high pressure in the vacuum pressure space 21). The flag 52 functions selectively to block or to pass light energy that is produced by a light emitting diode (LED) 54 or other light source in response to the pressure condition within the switch pressure boundary 22. This type of sensor is more fully described in the aforementioned United States Patent Application Publication No. US 2005/0258342 A1. The lockout apparatus 50 incorporates three light sensitive diodes (LSD) 56, 58, 60 or other light detecting devices. The first light sensitive diode 56 is positioned to receive light from the LED 54 regardless of the switch operability, and to generate a current signal R1 in response to such received light. Signal R1 is fed into controller 36 along with current signal C1 responsive to current being supplied by the power source 62 and current signal S1 responsive to a current being supplied to LED 54. Second light sensitive diode 58 is positioned to receive light from LED 54 only when the flag 52 is in its normal operating position (i.e. when a proper level of vacuum exists in the vacuum pressure space 21). A current sensor associated with LSD 58 provides signal R2 to controller 36 responsive to the light received by LSD 58. Third LSD 60 is positioned to receive light from LED 54 only when the flag 52 is in its switch failure position (i.e. when a degraded level of vacuum exists in the vacuum pressure space 21). A current sensor associated with LSD 60 provides signal R3 to controller 36 responsive to the light received by LSD 58. An auto-compensation loop 61 monitors the light output of LED 54 and automatically adjusts the output of power source 62 to maintain the light output within a predetermined range.

Upon sensing a degraded vacuum condition, controller 36 is programmed to provide appropriate output signal(s) 64, 66, 68. Error indication signal 64 may be used to energize an indicator 70, such as a signal light or screen display indication associated with the switch control system. Opening circuit inhibitor signal 66 may be used to activate an opening circuit inhibitor 72, such as the contactor 38 discussed with respect to FIG. 1, for automatically preventing the electrical movement of the switch contact points 18. Electrometrical inhibitor signal 66 may be used to activate an electromechanical opening inhibitor 74, such as a solenoid driven mechanical latch that prevents the manual movement of the switch contact points 18.

Figure 3:
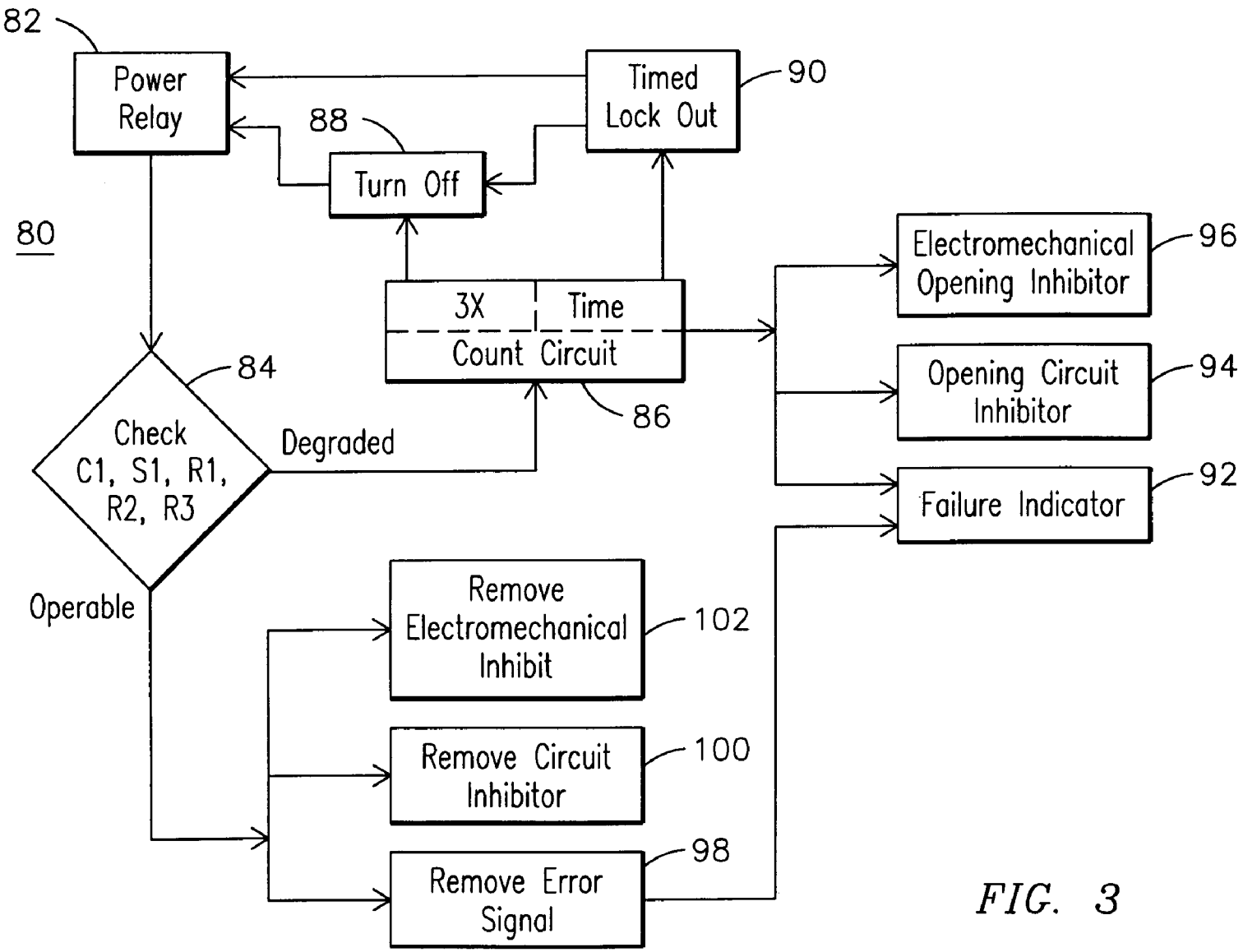
FIG. 3 is a logic diagram associated with the lockout apparatus of FIG. 2.

FIG. 3 is a logic diagram of one embodiment of the logic 80 that may be implemented by controller 36 for the lockout apparatus of FIG. 2. When power relay 82 first provides power to the circuit, the logic 80 initiates an auto-check at step 84 to confirm that the values of each of the current signals C1, S1, R1, R2 and R3 are within defined ranges of acceptability. If all of the signals are within acceptable ranges, the switching apparatus is declared to be operable; if not, the switching apparatus is declared to be degraded. A count circuit 86 may be used to require multiple checks prior to taking action, such as a 3-times counter requiring three findings of an unacceptable current prior to declaring the switch as degraded, or a timing circuit to require a finding of an operable switch within a defined time period prior to a default finding of a degraded switch. Upon passing of the count circuit 86 gate, the power to the system is turned off at step 88 or timed-out at step 90, and one or more automatic lockout steps 92, 94, 96 are taken, corresponding to the automatic lockout elements 70, 72, 74 of FIG. 2. If the switch is declared operable at step 84, all such automatic lockout elements are deactivated at respective steps 98, 100, 102.

The built-in redundancy of the light paths and current measurements described in FIGS. 2 and 3 provides a high level of assurance that false indications of degraded vacuum are minimized. For example, if only a single LSD were used to receive light from the LED, a low current value on that single LSD may be misdiagnosed as a degraded vacuum condition even if the low current value were due to a failed power supply, a failed LED, or a mis-positioned flag. In the embodiment of FIGS. 2 and 3, a degraded vacuum condition may be defined as the occurrence of a low current value for R2 together with the simultaneous occurrence of a high current value for R3. Such embodiment would not require LSD 56 or signals C1, S1 or R1. However, for a more thorough diagnosis of the sensor performance, all of the signals C1, S1, R1, R2 and R3 may be analyzed together to diagnose various types of failures, such as a loss of power (low C1 value), a failed LED (low R1 value), a failure of any of the LSD's (inappropriate combination of current values S1, R1, R2 and R3), etc.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An electrical switching apparatus for high voltage electrical power comprising:

a pressure boundary defining a vacuum pressure condition within the pressure boundary;

electrical contact points within the pressure boundary arranged for relative movement between a closed position in which the contact points are in engagement for a flow of electrical current through the switching apparatus and an open position in which the contact points are spaced apart to block the flow of electrical current, with the vacuum pressure condition minimizing arcing between the contact points when they are moved between the positions at high voltage potential;

a sensor generating a vacuum signal responsive to the vacuum pressure condition; and a control element responsive to a control signal to control movement of the contact points between the open and closed positions and further responsive to the vacuum signal to prevent movement of the contact points between the open and closed positions when the vacuum pressure condition is degraded within the pressure boundary.

2. The apparatus of claim 1, wherein the control element comprises a solenoid selectively energized by a power supply to move the contact points, and further comprising:

a contactor connected in series with the power supply and the solenoid, the contactor selectively opened in response to the vacuum signal when the vacuum pressure condition is degraded to prevent energizing of the solenoid and movement of the contact points.

3. The apparatus of claim 1, wherein the control element further comprises an electromechanical opening inhibitor responsive to the vacuum signal to prevent manual movement of the contact points.

4. The apparatus of claim 1, further comprising:

database storing data indicative of a history of the pressure condition in the vacuum pressure space; and a processor accessing the database and providing trending information developed from the history of the pressure in the vacuum pressure space.

5. The apparatus of claim 1, further comprising:

an environmental sensor generating an environmental signal responsive to a parameter of an environment of the pressure boundary; and a database storing data indicative of a history of the pressure signal and a corresponding history of the environment signal.

6. The apparatus of claim 1, wherein:

the sensor comprises a source of light, a first light sensing device positioned to receive the light regardless of a value of pressure within the pressure boundary, a second light sensing device positioned to receive the light only when a value of pressure within the pressure boundary is acceptable and not when it is degraded, and a third light sensing device positioned to receive the light only when a value of pressure within the pressure boundary is degraded and not when it is acceptable; and the control element comprises logic executable by a controller to determine whether pressure within the pressure boundary is acceptable or is degraded in response to outputs of the source of light, the first light sensing device, the second light sensing device and the third light sensing device.

7. The apparatus of claim 1, wherein:

the sensor comprises a source of light, a light sensing device positioned to receive the light only when a value of pressure within the pressure boundary is acceptable and not when it is degraded, and a light sensing device positioned to receive the light only when a value of pressure within the pressure boundary is degraded and not when it is acceptable; and logic executable by the controller to determine whether pressure within the pressure boundary is acceptable or is degraded in response to outputs of the light sensing device positioned to receive the light only when a value of pressure within the pressure boundary is acceptable and not when it is degraded, and the light sensing device positioned to receive the light only when a value of pressure within the pressure boundary is degraded and not when it is acceptable.

8. An electrical switching apparatus for high voltage electrical power comprising:

a vacuum interrupter comprising contact points disposed in a vacuum pressure space;

a drive mechanism associated with the vacuum interrupter for selectively moving the contact points between open and closed positions in response to a control signal;

a sensor providing a vacuum signal responsive to a pressure condition in the vacuum pressure space;

a controller associated with the drive mechanism and receiving operator input from a location remote from the drive mechanism for remote control operation of the vacuum interrupter;

wherein the controller is responsive to the vacuum signal to prevent operator-initiated remote control of the vacuum interrupter when the sensor detects a raised pressure condition in the vacuum pressure space.

9. The apparatus of claim 8, further comprising an indicator disposed remote from the vacuum interrupter and activated by the controller responsive to the vacuum signal to provide a remote indication of the raised pressure condition.

10. The apparatus of claim 8, further comprising a lockout contactor controlled by the controller for automatically preventing the energizing of a solenoid connected to the contact points when the sensor detects the raised pressure condition.

11. The apparatus of claim 8, further comprising an electromechanical opening inhibitor controlled by the controller for mechanically preventing movement of the contact points when the sensor detects the raised pressure condition.

12. The apparatus of claim 8, further comprising:

the drive mechanism comprising a solenoid for moving the contact points between the open and closed positions;

the controller selectively connecting the solenoid to a power supply in response to the operator input for moving the contact points between the open and closed positions; and a contactor in series with the solenoid and power supply and opened by the controller to prevent the operator-initiated remote control of the vacuum interrupter when the sensor detects a pressure condition in the vacuum pressure space exceeding a threshold value.

13. The apparatus of claim 8, further comprising:

an environmental sensor providing an environmental signal responsive to a parameter of an environment of the vacuum pressure space; and a database storing data indicative of a history of the vacuum signal and a corresponding history of the environment signal.

14. The apparatus of claim 8, wherein:

the sensor comprises a source of light, a first light sensing device positioned to receive the light regardless of a value of pressure within the pressure boundary, a second light sensing device positioned to receive the light only when a value of pressure within the pressure boundary is acceptable and not when it is degraded, and a third light sensing device positioned to receive the light only when a value of pressure within the pressure boundary is degraded and not when it is acceptable; and the control element comprises logic executable by a controller to determine whether pressure within the pressure boundary is acceptable or is degraded in response to outputs of the source of light, the first light sensing device, the second light sensing device and the third light sensing device.

15. The apparatus of claim 8, wherein:

the sensor comprises a device emitting light, a light sensing device positioned to receive the light only when a value of pressure within the pressure boundary is acceptable and not when it is degraded, and a light sensing device positioned to receive the light only when a value of pressure within the pressure boundary is degraded and not when it is acceptable; and logic executable by the controller to determine whether pressure within the pressure boundary is acceptable or is degraded in response to outputs of the light sensing device positioned to receive the light only when a value of pressure within the pressure boundary is acceptable and not when it is degraded, and the light sensing device positioned to receive the light only when a value of pressure within the pressure boundary is degraded and not when it is acceptable.

16. An electrical switching apparatus for high voltage electrical power comprising:

a vacuum interrupter comprising contact points disposed in a vacuum pressure space;

a sensor providing a vacuum signal responsive to pressure in the vacuum pressure space;

a database storing data indicative of a history of the pressure in the vacuum pressure space; and a processor accessing the database and providing trending information developed from the history of the pressure in the vacuum pressure space.

17. The apparatus of claim 16, further comprising:

a second sensor providing an environment signal responsive to a parameter of the environment of the vacuum interrupter; and the database comprising a correlation of the history of the pressure in the vacuum pressure space and a corresponding history of the environmental parameter.

18. The apparatus of claim 16, further comprising:

a drive mechanism remotely controllable by an operator for moving the contact points between open and closed positions; and a lockout apparatus responsive to the vacuum signal for automatically preventing operator-initiated movement of the contact points when pressure in the vacuum pressure space exceeds a predetermined value.

19. The apparatus of claim 18, wherein the lockout apparatus comprises a contactor connected in series with a power supply of the drive mechanism, the contactor selectively opened in response to the vacuum signal.

20. The apparatus of claim 18, wherein the lockout apparatus comprises an electromechanical opening inhibitor responsive to the vacuum signal to prevent manual movement of the contact points.

* * * * *